US006788173B2

(12) United States Patent
Germain et al.

(10) Patent No.: US 6,788,173 B2
(45) Date of Patent: Sep. 7, 2004

(54) RESET LOCKOUT AND TRIP FOR CIRCUIT INTERRUPTING DEVICE

(75) Inventors: Frantz Germain, Rosedale, NY (US); Stephen Stewart, Uniondale, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/137,020

(22) Filed: May 1, 2002

(65) Prior Publication Data

US 2003/0206085 A1 Nov. 6, 2003

(51) Int. Cl.[7] ..... H01H 73/00
(52) U.S. Cl. ..... 335/18; 361/42
(58) Field of Search ..... 335/18, 165–176; 361/42–51

(56) References Cited

U.S. PATENT DOCUMENTS 6,040,967 A * 3/2000 DiSalvo ..... 361/42
6,282,070 B1 * 8/2001 Ziegler et al. ..... 361/42
6,381,112 B1 * 4/2002 DiSalvo ..... 361/42

* cited by examiner

*Primary Examiner*—Lincoln Donovan
(74) *Attorney, Agent, or Firm*—Paul J. Sutton

(57) ABSTRACT

This invention relates to a circuit interrupting device having a trip button for disconnecting a load from a source of electrical power and a reset button for resetting the device after it has tripped. When the device is operating in its reset state, a source of electrical power is connected to a load through a set of contacts located within the device. The contacts are held closed by the spring loaded reset button which holds captive and urges a latch plate to move up to close normally open contacts. In the preferred mechanical trip mechanism, depressing the trip button causes the latch plate to move forward and be released from the reset button. The latch plate, upon being released from the reset button moves down to allow the contacts, which are biased to be normally open, to assume their normally open position. At this time, pressing the reset button initiates an electrical cycle which causes the normally open contacts to close only if the device is operating properly and there is no fault on the line. The device described is mechanically tripped and electrically reset, and it can be tripped without power being supplied to the device.

18 Claims, 4 Drawing Sheets

10
12
14
16
18
20
20
20
21
22
22
24
26
28
30
32
34
36
RESET
TEST

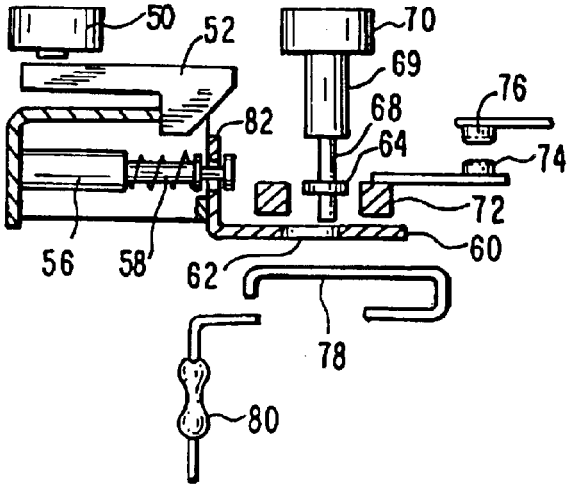
FIG.2
FIG.3
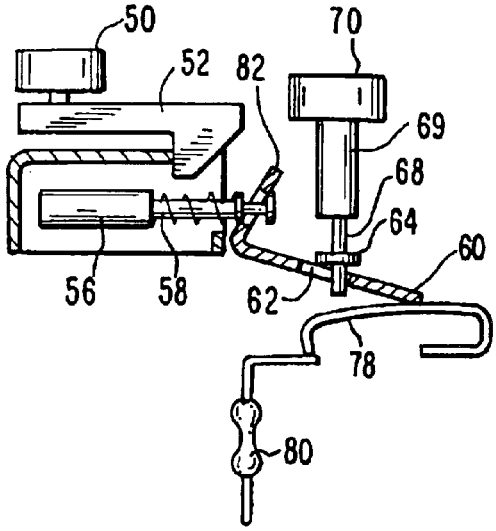
FIG.4
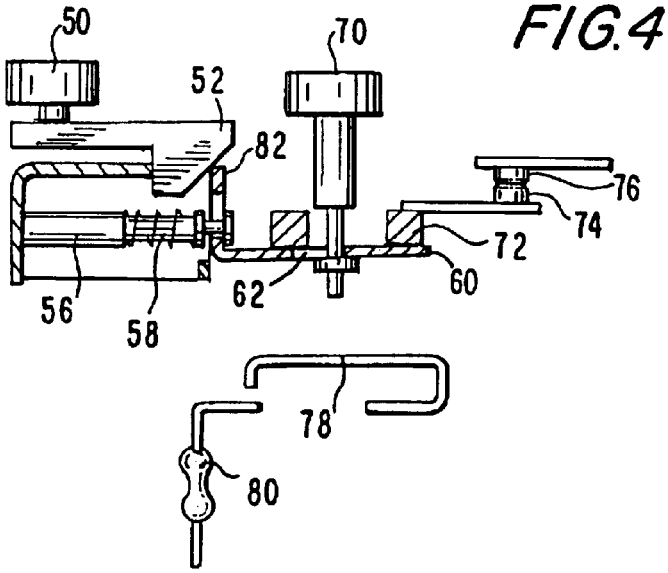

RESET LOCKOUT AND TRIP FOR CIRCUIT INTERRUPTING DEVICE

BACKGROUND OF THE INVENTION

1. Field of the Invention

The present invention relates to resettable circuit interrupting devices and systems which includes ground fault circuit interrupters (GFCI's), arc fault circuit interrupters, immersion detection circuit interrupters, appliance leakage circuit interrupters, circuit breakers, contactors, latching relays and solenoid mechanisms. More particularly, the present invention relates to a method and apparatus for resetting and testing such devices which are capable of being "locked out" such that the device cannot be reset if the device becomes non-operational or if an open neutral condition exists.

2. Description of Related Art

The electrical wiring device industry has witnessed an increasing need for circuit breaking devices which are designed to interrupt power to various loads, such as household appliances, consumer electrical products and branch circuits. In particular, electrical codes require electrical circuits in home bathrooms and kitchens to be equipped with ground fault circuit interrupters. Presently available GFCI devices, such as the device described in commonly owned U.S. Pat. No. 4,595,894 (the "'894 patent") use a trip mechanism to mechanically break an electrical connection between one or more input and output conductors. Such devices are resettable after they are tripped by, for example, the detection of a ground fault. In the device of the '894 patent, the trip mechanism used to cause the mechanical breaking of the circuit (i.e., the connection between input and output conductors) includes a solenoid or trip coil. A test button is used to test the trip mechanism and circuitry used to test for faults, and a reset button is used to reset the electrical connection between input and output conductors.

However, instances may arise where an abnormal condition, caused by, for example, a lightening strike occurs which may result not only in a surge of electricity at the device but also a disabling of the trip mechanism used to cause the mechanical breaking of the circuit. This may occur without the knowledge of the user. Under such circumstances an unknowing user, faced with a GFCI which has tripped, may press the reset button which, in turn, will cause the device with an inoperative trip mechanism to be reset without the ground fault protection available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (verses load) side of the GFCI device, an instance may arise where a current path is created from the phase (or hot) wire supplying power to the GFCI device through the load side of the device and a person to ground. In the event that an open neutral condition exists, current GFCI devices which have tripped, may be reset even though the open neutral condition may remain.

The device described in commonly owned U.S. Pat. No. 6,040,967, ('967) relates to resettable circuit interrupting devices, such as but not limited to GFCI devices, that include a reset lock-out mechanism which prevents the resetting of electrical connections or continuity between input and output conductors if the circuit interrupter used to break the connection is non-operational or if an open neutral condition exists. In this device, both the test button used to test the trip mechanism and circuitry used to sense faults, and the reset button used to reset the electrical connection between input and output conductors requires electrical power to operate an electrical component. A GFCI that can be tripped manually without requiring electrical power is desirable.

SUMMARY OF THE INVENTION

The present application relates to resettable circuit interrupting devices, such as, but not limited to, GFCI devices, that include a reset lock-out mechanism which prevents the resetting of electrical connections between input and output conductors if the circuit interrupter used to break the connection is non-operational or if an open neutral condition exists. The circuit interrupter includes a trip mechanism used to cause the breaking of continuity between the input and output conductive paths or conductors and the sensing circuit used to sense faults.

In one embodiment, the circuit interrupting device includes a housing, an input conductive path and an output conductive path. The input conductive path is disposed at least partially within the housing and is capable of being electrically connected to a source of electricity. The output conductive path is also disposed at least partially within the housing and is capable of conducting electrical current to a load when electrical continuity is established with the input conductive path. Electrical continuity between the conductive paths may be established using electromechanical mechanisms, such as movable electrical contacts and solenoids. The device also includes a circuit interrupted disposed within the housing and configured to break electrical continuity between the input and output conductive paths in response to the occurrence of a predetermined condition. Predetermined conditions include, without limitation, ground faults, arc faults, appliance leakage faults and immersion faults.

In response to the occurrence of the predetermined condition, a reset lock-out operable in a lock-out position and in a reset position is set to one of the positions. In the lock-out position, the reset lock-out inhibits resetting of electrical continuity between the input and output conductive paths, and in the reset position, the reset lock-out does not inhibit resetting of electrical continuity between the input and output conductive paths. The circuit interrupting device includes a reset mechanism operatively associated with the reset lock-out and the circuit interrupter. Activation of the reset mechanism activates the circuit interrupter which facilitates changing the operable position of the reset lock-out from the lock-out position to the reset position.

The circuit interrupter includes what is referred to synonymously herein as either a test or trip button for disconnecting a load from a source of electrical power and a reset button for resetting the device after it has tripped. When the device is operating in its reset state, a source of electrical power is connected to a load through a set of contacts located within the device. The contacts are held closed by the spring loaded reset button which holds captive a latch plate that urges the normally open contacts to a closed condition. In the preferred mechanical trip mechanism, depressing the trip button causes the latch plate to move forward to be released from the reset button. The latch plate, upon being released from the reset button moves down as a result of leaf spring downward biasing thereof to allow the contacts, which are biased as a result of this downward biasing to be normally open, to assume that normally open position. At this time, pressing the reset button initiates an electrical cycle which causes the normally open contacts to close only if the device is operating properly and there is no fault on the line. The device described is mechanically tripped, and both mechanically and electrically reset, and it can be tripped without power being supplied to the device.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart form the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which:

FIG. 2 is a side elevation view, partly in section, of a reset mechanism for the GFCI device shown in FIG. 1, illustrating components of the trip and reset mechanism and the GFCI device in a lock-out mode;

FIGS. 3–4 are schematic representations of one embodiment of the trip and reset mechanism of the present invention illustrating a latching member used to make an electrical connection between input and output conductors and to relate the reset mechanism of the electrical connection with the operation of the electrical reset, mechanical trip mechanism;

DETAILED DESCRIPTION

Figure 1:
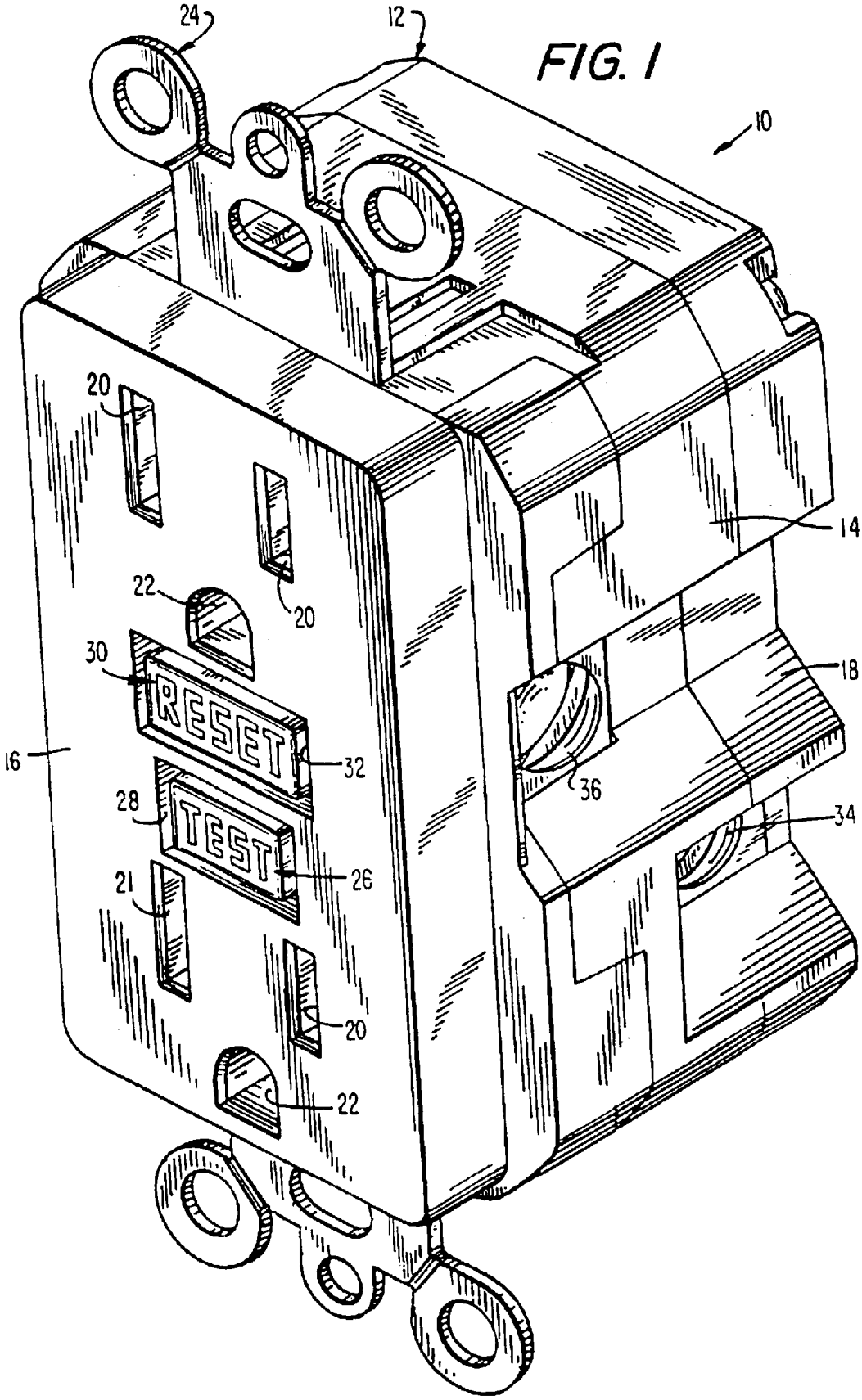
FIG. 1 is a perspective outer view of an example of a ground fault circuit interrupter according to the present invention.

The present application provides a reset lock-out mechanism for resettable circuit interrupting devices, such as GFCI devices, that relates the resetting of electrical connections between input and output conductive paths or conductors to the operation of a circuit interrupter or circuit interrupting mechanism.

For the purposes of the present application, the reset lock-out mechanism according to the present application shown in the drawings and described below is incorporated into a GFCI receptacle suitable for installation in a single-gang junction box in a home. However, the reset lock-out mechanism according to the present application is contemplated as also being included in any of the various devices in the family of resettable circuit interrupting devices, including ground fault circuit interrupters (GFCI's), arc fault circuit interrupters (AFCI's), immersion detection circuit interrupters (IDCI's), appliance leakage circuit interrupters (ALCI's).

Turning now to FIG. 1, the GFCI receptacle 10 includes a housing 12 consisting of a central body 14 to which a face or cover portion 16 and a rear portion 18 are removably secured. The face portion 16 has entry ports 20 for receiving normal or polarized prongs of a male plug of the type normally found at the end of a lamp or appliance cord set (not shown), as well as ground-prong-receiving openings 22 to accommodate a three-wire plug. The receptacle also includes a mounting strap 24 used to fasted the receptacle to a junction box.

A mechanical trip button 50, which may be designated as a "test" button for consumer convenience, extends through opening 28 in the face portion 16 of the housing 12. The mechanical trip button is used to mechanically trip the circuit interrupting mechanism disposed in the device. The circuit interrupter, to be described in more detail below, is used to break electrical continuity between input and output conductive paths or conductors. A reset button 70 forming a part of a reset mechanism extends through opening 32 in the face portion 16 of the housing 12. The reset button is used to activate a reset cycle, which re-establishes electrical continuity between the input and output conductive paths of conductors.

Electrical connections to existing household electrical wiring are made via binding screws 34 and 36, where screw 34 is an input (or line) connection point and screw 36 is an output (or load) connection point. It should be noted that two additional binding screws (not shown) are located on the opposite side of the receptacle 10. Similar to binding screws 34 and 36, these additional binding screws provide input and output connection points. Further, the input connections are for line side phase (hot) and neutral conductors of the household wiring, and the output connections are for load side phase (hot) and neutral conductors of the household wiring. The plug connections are also considered output conductors. A more detailed description of a GFCI receptacle is provided in U.S. Pat. No. 4,595,894 which is incorporated herein in its entirety by reference.

Figure 5:
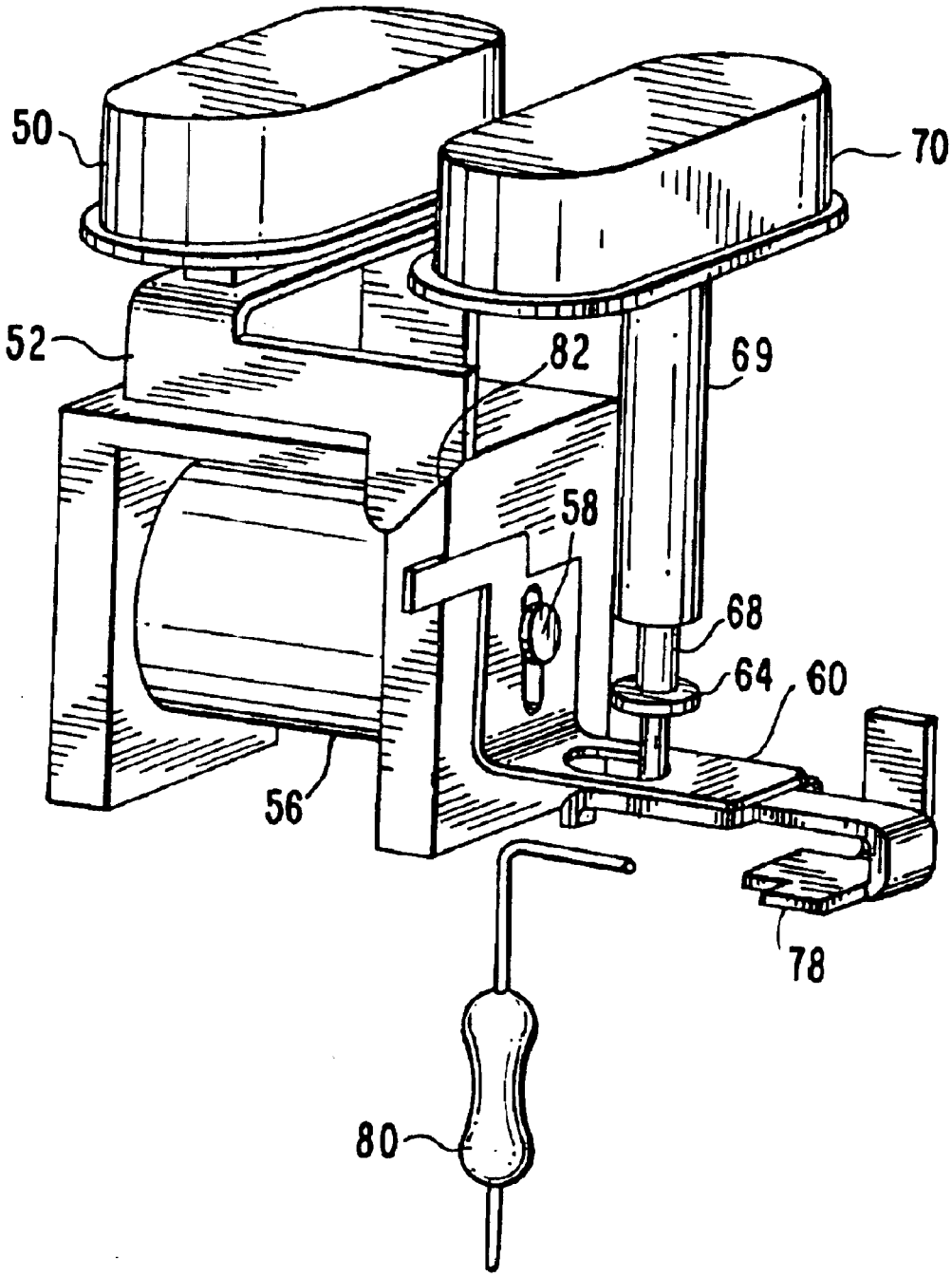
FIG. 5 is a perspective view of the reset mechanism and the electrical reset, mechanical trip mechanism.
Figure 6:
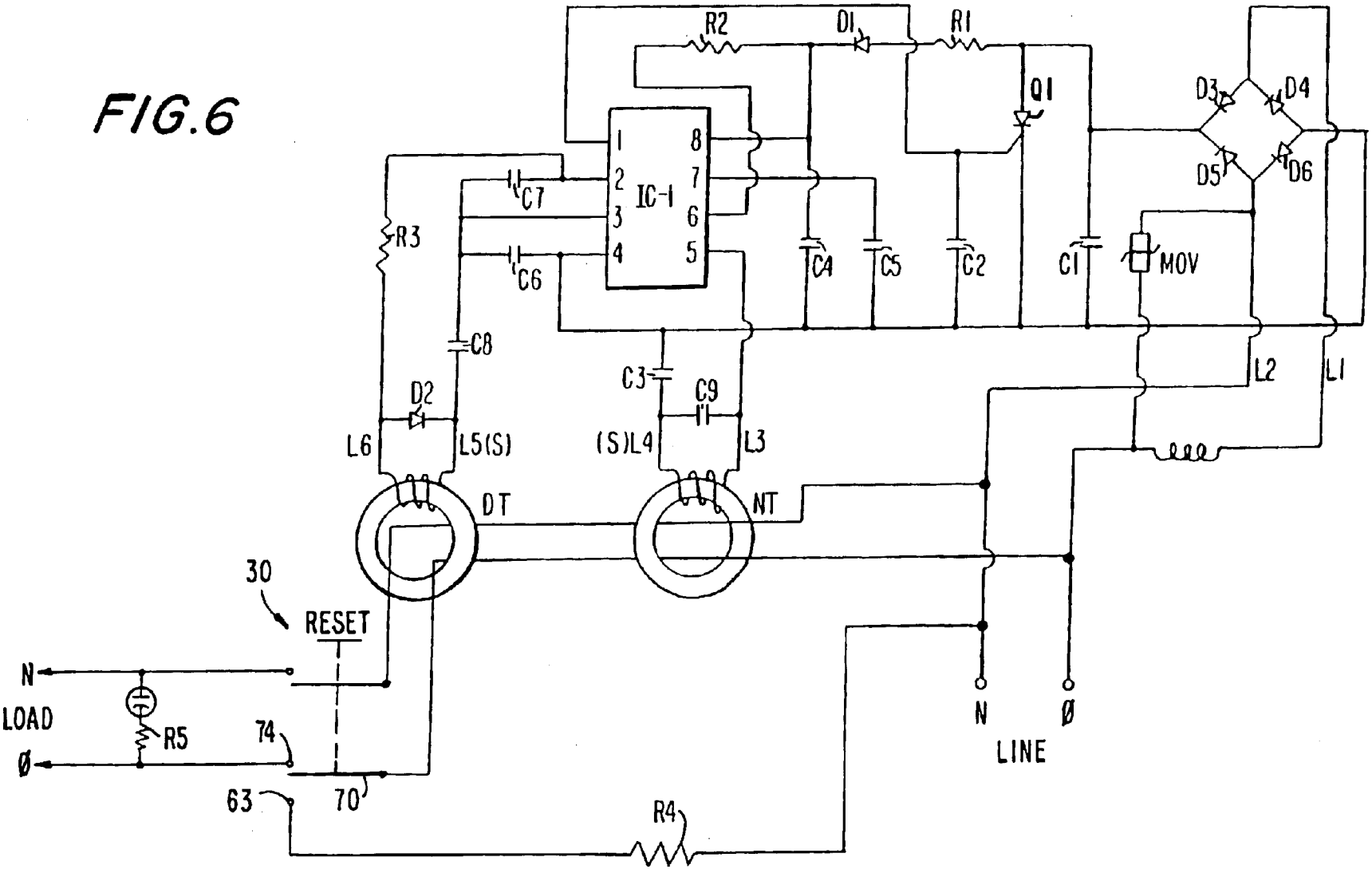
FIG. 6 is a schematic diagram of a circuit which can be used with the GFCI device of FIG. 1 for detecting ground faults.

Referring to FIGS. 2 and 4, there is shown mechanical components of trip and reset mechanism according to one embodiment of the present invention. In FIG. 2, the device is in the lock-out mode and the load is disconnected from the source of electrical power. The mechanical trip mechanism includes trip button 50 which, when depressed, urges trip arm 52 to move down to engage an end 82 of latch plate 60. The end of trip arm 52 is angled at 45 degrees and functions as a cam to urge latch plate 60 to move to the right. As will be explained below, switch arm 52 is biased upward by a spring (not shown) and can engage latch plate 54 only when the device is in the reset mode as shown in FIG. 5. The end of the trip arm cannot engage the end of latch plate 54 when the device is in the lock out mode as shown in FIG. 2.

The electrical trip mechanism includes a coil assembly 56, a plunger 58 responsive to the energizing and de-energizing of the coil assembly and latch plate 60 connected to plunger 58. The latch plate has an opening 62 which cooperates with a flange 64 on a pin 68 of reset button 70. Reset button 70 is pressed to reset the device. A spring (not shown) biases reset button 70 upward. The diameter of opening 62 in the latch plate is slightly larger than the diameter of the flange 64 on the pin 68 to permit the flange to pass through. The flange 64 and pin 68 are of conductive material and the upper part 69 of reset button 70 is electrically non-conducting. Spacer member 72, which is made of non-conducting material and contains a clearance opening for flange 64, sits on latch plate 60 and is connected to movable contact 74 which cooperates with fixed contact 76. Movable contact 74 and spacer member 72 are biased downward by a spring (not shown). Located below latch plate 60 is test spring 78 which is anchored in cantilever fashion at its right end and rotates counterclockwise when contacted by downwardly moving latch plate 60. Test spring 78 is connected to a source of electrical power and, when rotated by downward moving latch plate 60 (see FIG. 3), contacts and feeds current to the end of resistor 80 which is connected to coil assembly 56. As noted above, a spring is provided to bias reset button 70 in the up direction and movable contact 74 is biased in the down direction by another spring where the spring of the reset button is stronger that the spring of the movable contact.

The electrical trip mechanism is activated in response to the sensing of a ground fault by, for example, the electronic circuitry shown in FIG. 5. FIG. 5 includes a conventional circuitry for detecting ground faults that include a differential transformer that senses current unbalances. As noted, the fault sensing circuitry is included in the circuit interrupter.

FIGS. 2–4 show the mechanical components of the mechanical trip, electrical reset mechanism in various stages of operation. In FIG. 2, the GFCI receptacle is shown in the lock-out mode where movable contact 74 is in its biased down position and separated from fixed contact 76. To reset the GFCI, reset button 70 is pressed down against the force of the upward urging spring. As the reset button moves down, the bottom end of pin 68 passes through opening 62 and the bottom surface of flange 64 contacts the top surface of the latch plate 60 because the opening 62 is not aligned with flange 64. Continued downward pressure on the reset button causes the far right end of the latch plate 60 to rotate downward and engage and move test spring 78 counter-clockwise until it makes contact with the end of resistor 80, which allows current to flow through the latch plate 60 to resistor 80 and then to the coil assembly 56. See FIG. 3. Latch plate 60 is conducting to allow current to pass from test spring 78 to the coil via the resistor. To isolate the user from the current, the top portion 69 of the reset button is made of non-conducting material.

At this instant, activation of the coil assembly causes plunger 58 to move to the right which drives latch plate 60 to the right to align the opening 62 with flange 64. When alignment occurs, latch plate 60 moves up and over flange 64. The upward movement of latch plate 60 allows test spring 78 to move up and electrical power is removed from the coil assembly. This causes plunger 58 to pull latch plate 60 to the left. The movement of latch plate 60 to the left offsets the opening 62 in the latch plate with respect to flange 64 and, as the reset button is released, the top surface of the flange contacts and pulls the latch plate upward. Upward movement of latch plate 62 causes spacer member 72 and moveable contact 74 to move up and contact 74 contacts fixed contact 76. See FIG. 4. As noted above, the upward force of the spring of the reset button is greater than the downward force of the spring biased movable contact 74. Therefore, the upward force of the reset button, in addition to closing contacts 74, 76, pulls the latch plate up to a new raised location where the top edge 82 of the latch plate can now be contacted by the angled end of the trip arm 52. As noted previously, the angled end of the trip arm can contact the top edge of the latch plate only when the device is in the reset mode, it can not do so when the device is in the lock-out mode.

It is to be noted that the description thus far has been in terms of a single movable contact 74 and a single fixed contact 76. However, there are preferably two sets of movable contacts 74 and fixed contacts 76, one set for the input conductors; and the other set for the output conductors.

At this time the device is in the reset mode. Periodically, the device should be tested for operability. This can be done by pressing the trip button which causes contacts 74, 76 to open which brakes the electrical connection between the load and the source of power. It is to be noted that the tripping of the device is purely mechanical and no electrical current is needed. Therefore, by pressing the reset button, current is fed through the coil assembly to cause contacts 74, 76 to close as explained above. This cycling of the coil assembly and the closing of the contacts 74, 76 is the successful testing of the operation of the coil. If the coil assembly is defective, it would not operate and the contacts can not close.

Referring to FIG. 4, to manually trip the device, the trip or test button 50 is pressed down against the force of a spring (not shown) which biases the button and trip arm in a raised position. Downward movement of the trip arm moves the angled end of the trip arm into engagement with the top edge 82 of the latch plate 60 to move the latch plate to the right. As the latch plate moves to the right, opening 62 in the latch plate moves into alignment with flange 64. When the two are in alignment, the flange moves up through the opening 62. When this occurs, movable contact 74, through the action of its downward biased spring, moves down and contacts 74, 76 open. In addition, downward biased movable contact 74, acting through spacer member 72, moves latch plate to its down location. When latch plate 60 is in its down position, the angled edge of trip arm cannot engage the top edge 82 of latch plate. At this time the device is in its lock out mode as shown in FIG. 2. It is to be noted that the described device is mechanically tripped and electronically reset and that it can be tripped independently of whether or not there is power being supplied to the device.

Using the reset lock-out feature described above permits the resetting of the GFCI device or any of the other devices in the family of circuit interrupting devices only if the circuit interrupter (or circuit interrupting mechanism) is operational.

While there have been shown and described and pointed out the fundamental features of the invention as applied to the preferred embodiment, as is presently contemplated for carrying them out, it will be understood that various omissions and substitutions and changes of the form and details of the device described and illustrated and in its operation may be made by those skilled in the art, without departing from the spirit of the invention.

What is claimed is:

1. A mechanically tripped, electrically reset circuit interrupting device comprising:

a housing;

at least one input conductor disposed at least partially within said housing and capable of being electrically connected to a source of electricity;

at least one output conductor disposed within said housing and capable of conducting electrical current to a load when electrically connected to said at least one input conductor;

a circuit interrupter disposed within said housing and configured to break said electrical connection between said input and output conductors in response to the occurrence or a predetermined condition;

a reset lock-out responsive to the occurrence of said predefined condition such that said reset lock-out is operable between a lock-out position wherein said reset lock-out inhibits resetting of said electrical connection between said input and output conductors and a reset position wherein said reset lock-out does not inhibit resetting of said electrical connection between said input and output conductors; and a trip mechanism operatively associated with said reset lock-out and said circuit interrupter such that mechanical activation of said trip mechanism conditions said circuit interrupter to be electrically driven to said reset position by said reset mechanism.

2. The mechanically tripped, electrically reset circuit interrupting device according to claim 1, wherein said circuit interrupter comprises a coil assembly, a movable plunger responsive to energizing of said coil assembly and a latch plate attached to said plunger such that movement of said plunger is translated to movement of said latch plate and movement of said latch plate causes said reset lock-out to operate in said lock-out position or said reset position.

3. The mechanically tripped, electrically reset circuit interrupting device according to claim 2, wherein said input conductor has an electrical contact attached thereto and said output conductor has an electrical contact attached thereto, and at least one of said conductors is movable relative to the other such that said electrical connection is made when said input and output contacts are closed.

4. The mechanically tripped, electrically reset circuit interrupting device according to claim 3, wherein when said reset lock-out is in said lock-out position said contacts are inhibited from closing.

5. The mechanically tripped, electrically reset circuit interrupting device according to claim 1, wherein said reset mechanism comprises:

a trip button coupled to said reset lock-out only when said device is in its lock-out mode; and a reset contact that is activated when said reset button is depressed.

6. The mechanically tripped, electrically reset circuit interrupting device according to claim 1, wherein said predetermined condition comprises a ground fault, an arc fault, an appliance leakage fault, or an immersion fault.

7. A mechanically tripped, electrically reset ground fault interrupting device comprising:

a housing;

at least one input conductor disposed at least partially within said housing and capable of being electrically connected to a source of electricity;

at least one output conductor disposed within said housing and capable of conducting electrical current to a load when electrically connected to said at least one input conductor;

a circuit interrupter disposed within said housing and configured to break said electrical connection between said input and output conductors in response to the occurrence or a depression of a trip button with or without electrical current being received; and a reset mechanism having a reset lock-out responsive to activation of said circuit interrupter so as to be movable between a lock-out position wherein said reset lock-out inhibits resetting of said electrical connection between said input and output conductors and a reset position wherein said reset lock-out does not inhibit resetting of said electrical connection between said input and output conductors, wherein when said reset mechanism is activated said circuit interrupter is activated to facilitates movement of said reset lock-out from said lock-out position to said reset position by said reset mechanism and resets said electrical connection between said input and output conductors.

8. The mechanically tripped, electrically reset ground fault interrupting device according to claim 7, wherein said circuit interrupter comprises a coil assembly, a movable plunger responsive to energizing of said coil assembly and a latch plate attached to said plunger such that movement of said plunger is translated to movement of said latch plate and movement of said latch plate causes said reset lock-out to operate in said lock-out position or said reset position.

9. The mechanically tripped, electrically reset ground fault interrupting device according to claim 8, wherein said input conductor has an electrical contact attached thereto and said output conductor has an electrical contact attached thereto, and at least one of said conductors is movable relative to the other such that said electrical connection is made when said input and output contacts are closed.

10. The mechanically tripped, electrically reset ground fault interrupting device according to claim 9, wherein when said reset lock-out is in said lock-out position said contacts are inhibited from closing.

11. The mechanically tripped, electrically reset ground fault interrupting device according to claim 7, wherein said reset mechanism comprises:

a reset button coupled to said reset lock-out; and at least one reset contact that is activated when said reset button is depressed.

12. The mechanically tripped, electrically reset circuit interrupting device comprising;

housing means;

input conductor means disposed at least partially within said housing means and capable of being electrically connected to a source of electricity;

output conductor means disposed at least partially within said housing means and capable of conducting electrical current to a load when electrically connected to said input conductor;

circuit interrupting means disposed within said housing means for breaking said electrical connection between said input and output conductor means in response to the occurrence of a predetermined condition;

reset lock-out means responsive to manual depression of a reset means for resetting of said electrical connection between said input and output conductor means after said circuit interrupting means breaks said connection between said input and output conductor means; and reset means disposed within said housing means for activating said circuit interrupting means so that said lock-out means does not inhibit resetting of said electrical connection between said input and output conductor means and for resetting said electrical connection between said input and output conductor means.

13. The mechanically tripped, electrically reset circuit interrupting device according to claim 12, wherein said circuit interrupting means comprises a coil means, movable plunger means responsive to energizing of said coil means and latch means attached to said plunger means such that movement of said plunger means is translated to movement of said latch means and movement of said latch means causes said reset lock-out means to close said input and output contact means.

14. The mechanically tripped, electrically reset circuit interrupting device according to claim 13, wherein said input conductor means includes electrical contact means and said output conductor means includes electrical contact means, and wherein at least one of said conductor means is movable relative to the other such that said electrical connection is made when said input and output contacts means are closed.

15. The mechanically tripped, electrically reset circuit interrupting device according to claim 13, wherein said reset means comprises:

a reset button coupled to said reset lock-out means; and reset contact means that is activated when said reset button is depressed.

16. The mechanically tripped, electrically reset circuit interrupting device according to claim 12, wherein said predetermined condition comprises a ground fault, an arc fault, an appliance leakage fault, or an immersion fault.

17. A method for interrupting and resetting electrical connections in fault interrupting devices having a housing, an input conductor disposed at least partially within the housing and electrically connected to a source of electricity, and an output conductor disposed at least partially within the housing and capable of conducting electrical current to a load when electrical continuity between the input and output conductors is made, said method comprising:

sensing the occurrence of a predefined condition;

breaking electrical continuity between the input and output conductors when said predefined condition is sensed using a circuit interrupting mechanism;

enabling a lock-out mechanism to inhibit the making of electrical continuity between the input and output conductors after breaking electrical continuity between said conductors; and manually activating a reset mechanism that electrically activates said circuit interrupting mechanism to made electrical continuity between said input and output conductors only if the lock-out mechanism is not in a lock-out position which inhibits the making of electrical continuity between the input and output conductors.

18. The method according to claim 17, wherein said predefined condition comprises a ground fault, an arc fault, an appliance leakage fault or an immersion fault.

* * * * *